US005191703A

United States Patent [19]

John

[11] Patent Number: 5,191,703

[45] Date of Patent: Mar. 9, 1993

[54] METHOD OF MAKING AN ANILOX ROLLER OR CYLINDER

[75] Inventor: Thomas John, Augsburg, Fed. Rep. of Germany

[73] Assignee: MAN Roland Druckmaschinen AG, Offenbach am Main, Fed. Rep. of Germany

[21] Appl. No.: 762,582

[22] Filed: Sep. 19, 1991

[30] Foreign Application Priority Data

Nov. 17, 1990 [DE] Fed. Rep. of Germany ..... 4036661

[51] Int. Cl.[5] ..... B21B 31/08; B41F 31/26

[52] U.S. Cl. ..... 29/895.32; 29/895.33; 492/30

[58] Field of Search ..... 29/121.1, 121.2, 121,4, 29/132, 895, 895.3, 895.32, 895.33, DIG. 16, 121.5, 121.6, 121.7; 427/271, 423; 101/348, 349, 350; 204/9, 25

[56] References Cited

U.S. PATENT DOCUMENTS

| | | | |
|---|---|---|---|
| 3,018,540 | 1/1962 | Chavannes | 29/895.3 |
| 3,948,655 | 4/1976 | Wells | 427/271 X |
| 4,009,658 | 3/1977 | Heurich | 29/121.2 X |
| 4,380,852 | 4/1983 | Leschinsky et al. | 29/121.2 |
| 4,793,041 | 12/1988 | Jenkins et al. | 29/132 X |
| 4,879,791 | 11/1989 | Herb | 29/121.1 X |
| 4,993,320 | 2/1991 | Kochsmeier | 29/132 X |
| 5,056,220 | 10/1991 | Telama | 29/895.32 |

FOREIGN PATENT DOCUMENTS

| | | | |
|---|---|---|---|
| 1348020 | 10/1987 | U.S.S.R. | 29/895.32 |

*Primary Examiner*—Joseph M. Gorski
*Assistant Examiner*—Peter Dungba Vo
*Attorney, Agent, or Firm*—Frishauf, Holtz, Goodman & Woodward

[57] ABSTRACT

To facilitate the manufacture of an anilox roller for an inker of an offset rotary printing machine, a cylindrical core has a layer of ink accepting material, for example copper, applied thereon. To form wear-resistant ribs (8) between which ink receptor depressions or cells (19) can be formed, the layer (3) of ink accepting material is formed with grooves into which a hard, wear-resistant material is applied, completely filling the grooves. The ink receptor depressions or cells are then formed in the ink accepting material, which is softer than said wear-resistant material. The thickness of the ink accepting layer (3) originally applied is greater than the depth of the cells which, typically, have a depth of about 0.02 mm.

16 Claims, 2 Drawing Sheets

FIG.1
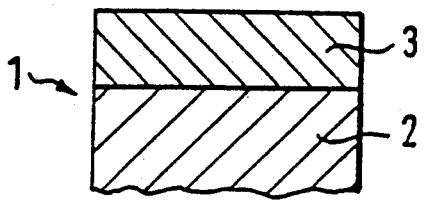
FIG.2
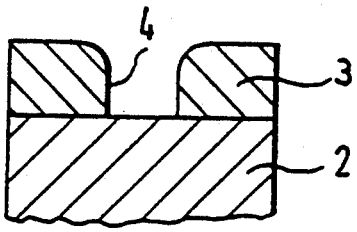
FIG.3
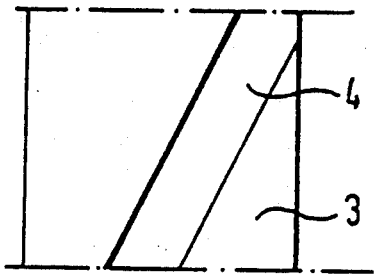
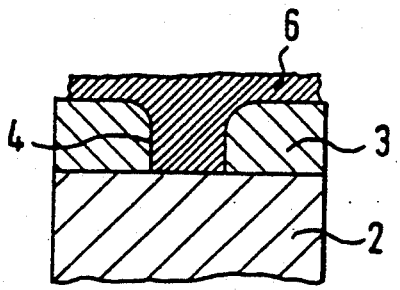
FIG.4
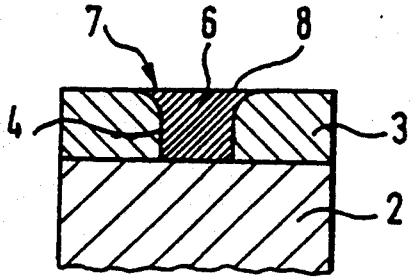
FIG.5

METHOD OF MAKING AN ANILOX ROLLER OR CYLINDER

REFERENCE TO RELATED PUBLICATION

German Patent Disclosure Document DE-OS 38 22 692.

FIELD OF THE INVENTION

The present invention relates to a method to make an engraved inker roller, also known as an anilox roller or cylinder, for an inker of a rotary printing machine, and more particularly of an offset rotary printing machine, which has ink receptors or cells located between ribs, in which the ribs are made of a hard, wear-resistant material. The ink receptors or cells are formed in a material which accepts ink and repels water, that is, is hydrophobic.

BACKGROUND

Anilox rollers are well known and German Patent Disclosure Document DE-OS 38 22 692 describes such a roller in which a roller or cylinder core carries a ceramic or metal layer of wear-resistant material. This layer is engraved to receive a layer ink accepting, water repelling or water rejecting, or hydrophobic material. Initially, the ink accepting layer is applied, with excess, on the roller which already carries the engraved layer of ceramic or metal wear-resistant material. The excess material of the ink accepting layer is then removed until the outer surfaces of the ribs of the wear-resistant material are free. The receptor depressions or cells are then placed or formed in the ink accepting layer between the freed ribs. Engraving the wear-resistant layer to form the cells leaving the ribs is carried out by means of a laser. This is a very expensive and time-consuming procedure.

THE INVENTION

It is an object to provide a method to make an anilox rollers which is fully compatible with anilox rollers of the prior art, but which is simple and does not require expensive engraving of a hard, wear-resistant layer, while resulting in an anilox roller which has a high lifetime.

Briefly, a layer of ink accepting material is applied on a cylindrical core, for example of steel, this layer having a thickness which exceeds the depth of receptor depressions or cells which the anilox roller is to have. Grooves are formed in this ink accepting material, which is inherently somewhat soft, for example by etching or by first masking the surface of the core cylinder before the ink accepting layer is applied. These grooves are then filled with wear-resistant material, so that the ribs will then be formed. These ribs can extend at an angle with respect to the axis of rotation of the roller, can crisscross, or can form a beehive or hexagonal pattern. The receptor depressions or cells are then formed by or in the layer of ink accepting material in the region between the ribs.

The thickness of the ink accepting material which is initially applied to the core cylinder or roller should be greater than the depth of the receptor depressions or cells.

The method has the advantage that only comparatively soft material need be removed to form the depressions or cells which, as well known, are very small.

DRAWINGS

FIG. 1 is a fragmentary cross-sectional view through a portion of an anilox roller adjacent the surface thereof, after a first process step;

FIG. 2 is a portion of the roller of FIG. 1 after a second process step;

FIG. 3 is a fragmentary developed view of the surface of FIG. 2;

FIGS. 4, 5 and 6 are views of the surface of FIG. 2 after further sequential process steps;

DETAILED DESCRIPTION

Figure 6:
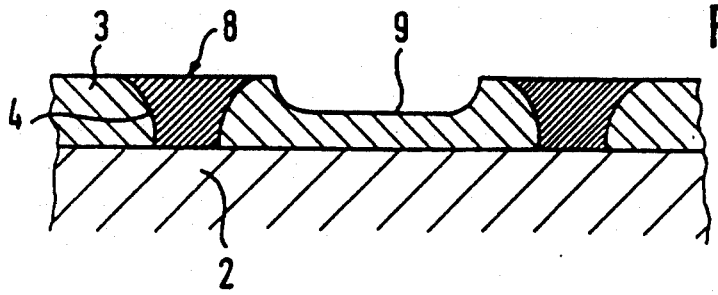
Figure 8:
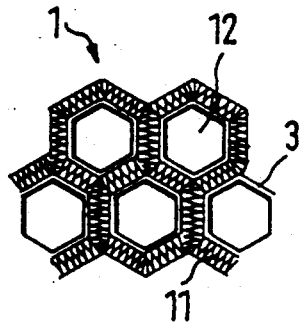
FIG. 8 is a developed top view of another form of ribs and depressions of the anilox roller, to a greatly reduced scale with respect to FIG. 7.

The anilox roller, shown at 1 only in fragmentary representation, has a roller or cylinder core 2. The core 2 is made, for example, of steel and has a diameter which is less by just a few tenths of a millimeter than the final diameter of the anilox roller 1.

In accordance with a feature of the invention, the core 2 is coated with a layer 3 of ink accepting material. The layer 3 may, for example, be made of copper, which is a material rejecting water, that is, is hydrophobic, while, at the same time, having a high affinity to printing ink. Rather than using copper, nickel, asphalt or a suitable plastic material such as polyamide-AA may be used. The layer 3 can be applied by spraying, vapor deposition or, if of metal, by galvanic deposition, or by chemical deposition.

In accordance with a feature of the invention, grooves 4 are formed in the layer 3. These grooves, preferably, extend down to the surface of the core 2, although this is not necessary. The grooves 4, as seen in FIG. 3, extend at an inclination with respect to the axis of rotation of the roller 1. The grooves 4 can be formed in various ways. For example, the grooves 4 can be formed by engraving the relatively soft ink accepting layer 3, by etching, or, in another embodiment, the grooves 4 can be formed initially by applying a coating, for example lacquer strips, on the surface of the roller 2 before the layer 3 is applied. This coating in strip form, where the grooves are to be formed, then will prevent adhesion of the layer 3 in the region of the grooves. The lacquer strips can then be removed after the layer 3 has been applied, for example by dissolving off the covering lacquer or varnish layer.

Hard, wear-resistant strips, on which doctor blades can ride, are then introduced into the grooves 4. The material of these strips may, for example, be chromium dioxide or aluminum oxide. The strips are applied, according to one feature of the invention, by placing a coating of the hard, wear-resistant material in form of a layer 6 over the grooved layer 3. This provides for secure bonding of the layer 6 with the core 2, if the grooves 4 extend down to the core 2; further, the material will bond with the adjacent surfaces of the material 3. The layer 6 can be applied, for example, by plasma-praying. Initially, it will cover at least in part the circumferential surface of the layer 3. To obtain an even uniform surface of the anilox roller 1, it is desirable to apply a surface treatment, in which the hard layer 6 is removed wherever it covers the ink accepting layer 3, e.g. by grinding. Since this is a procedure which involves the entire surface and does not require pointcontact application, it can be carried out rapidly and inexpensively. FIG. 5 illustrates the region of the resulting strips 6 after surface removal of an excess hard material. A polished, accurately ground surface 7 will be obtained. The surface 7 will be so smooth that the layer 6 fills only the grooves 4 within the ink accepting layer 3 and forms the hard, wear-resistant ribs 8.

In the next, and last step, the Ink accepting layer 3 is engraved in the region between the ribs 8 to form ink receptor depressions or cells 9. This can be done as well known, for example by etching, embossing by profile rollers, engraving, for example by needle or point engraving, by an electron beam, or the like.

The initial thickness of the layer 3 should be at least the depth of the cells or depressions 9. The depth of the receptor depressions or cells 9 is in the order of about 0.02 mm. The width of the grooves 4, and hence of the ribs 8, is in about the same order of magnitude, that is, also about 0.02 mm, although this dimension is not critical. It can be wider.

The result of the process will be a multi-layer surface configuration of the anilox roller 1, in which the layers are next to each other, and optimum selection of material for the rib portion or layer 8 and for the receptor or cell portion layer 2 is possible.

The method has the substantial advantage that the wear-resistant layer 6, against which the doctor blades will ride, need not be engraved. The engraving or deformation of the cells is always carried out in the ink accepting layer 3, which is comparatively soft. Thus, engraving and formation of the cells is simple and permits inexpensive and rapid manufacture.

Figure 7:
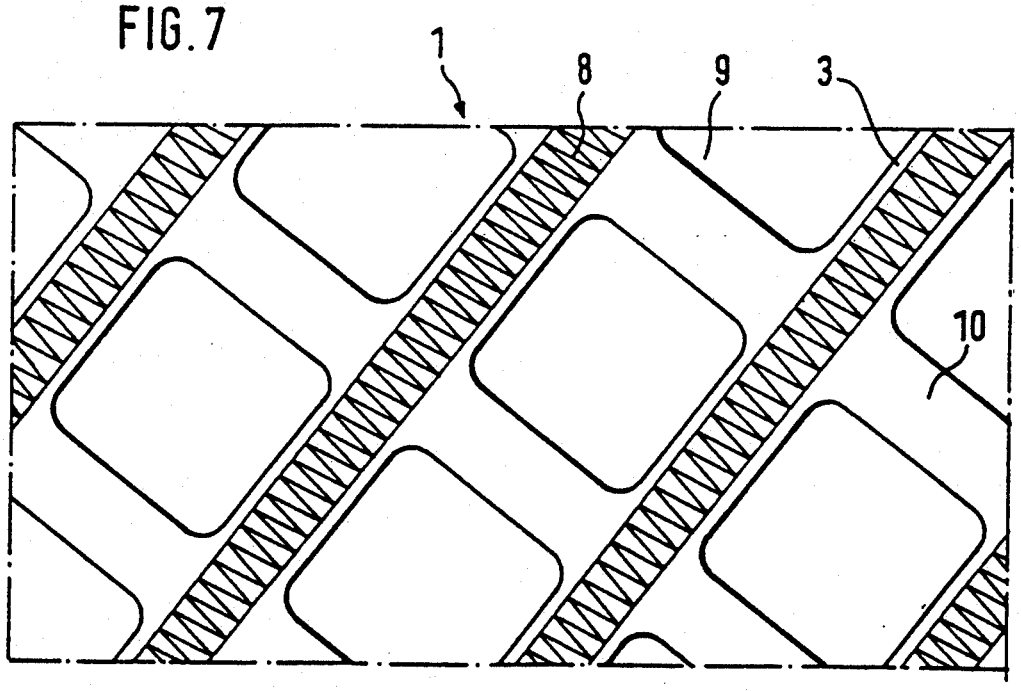
FIG. 7 is a developed top view of the finished anilox roller.

FIG. 7 illustrates the surface of the anilox roller 1 with inclined circumferentially surrounding ribs 8. The ribs 8 are embedded in the layer 3 of ink accepting, hydrophobic material, and are uniformly spaced about the circumference. The receptor cells 9 are engraved at uniform distances between the ribs 8. The receptor depressions and cells are delimited on the one hand by the wear-resistant ribs 8 and, on the other, by portions 10 which are formed of the ink accepting layer 3.

In accordance with a feature of the invention, the ribs 8 may also extend in criss-cross fashion, so that the ribs 10 likewise will be made of wear-resistant material, similar to the ribs 8. This merely requires formation of the grooves 4 in the second step of the process in criss-cross diagonal arrangement.

In accordance with another feature of the invention, the grooves 8 can be arranged in beehive or hexagonal pattern on the core 2 so that the resulting ribs 11 will have hexagonal shape. The receptor depressions or cells 12 are then engraved between the ribs 11 in the ink accepting layer 3.

Various changes and modifications may be made within the scope of the inventive concept.

I claim:

1. A method of making an anilox roller or cylinder, for use in an inker of a rotary printing machine, in which the anilox roller or cylinder (1) has a roller or cylinder core (2);

ribs (8) of wear-resistant material projecting from the core;

a layer (3) of ink accepting material between the ribs, located on the core (2) and formed with ink accepting receptor depressions or cells (9) which extend only through a portion of the thickness of said layer, said method comprising, the steps of applying a layer (3) of ink accepting material on a core (2) with a thickness which exceeds the depth of the receptor depressions or cells (9) to be formed on said ink accepting layer;

forming grooves (4) in said layer (3) of ink accepting material;

filling said grooves (4) with said wear-resistant material, thereby forming said ribs (8); and forming said receptor depressions or cells (9) in said layer (3) of ink accepting material in the regions between the ribs.

2. The method of claim 1, wherein said step of forming said grooves (4) comprises forming the grooves with a depth extending to the surface of said core (2).

3. The method of claim 1, wherein said step of forming said grooves comprises forming said grooves at an inclination with respect to the axis of rotation of the roller or cylinder (1).

4. The method of claim 1, wherein said step of forming said grooves comprises forming a plurality of grooves which cross each other, to thereby form a criss-cross pattern of grooves.

5. The method of claim 1, wherein said step of forming said grooves comprises forming said grooves in a beehive or hexagonal pattern.

6. The method of claim 1, wherein said step of filling said grooves (4) comprises applying a layer (6) of said wear-resistant material as a continuous layer over said layer (3) of ink accepting material, including filling of said grooves (4); and removing said layer (6) of wear-resistant material where said layer of ink accepting material is covered, to leave said ribs (8).

7. The method of claim 1, wherein said step of forming said grooves comprises removing said ink accepting material layer in the region of said grooves.

8. The method of claim 7, wherein said removal step comprises etching.

9. The method of claim 1, wherein said step of forming said grooves (4) comprises masking the surface of said roller or cylinder core (2) where the grooves are located; and then applying said layer of ink accepting material on said core.

10. The method of claim 9, wherein said masking step comprises applying strips of lacquer or varnish on said core.

11. The method of claim 1, wherein said step of applying said layer (3) of ink accepting material comprises flame spraying.

12. The method of claim 1, wherein said layer (3) of ink accepting material comprises a copper layer; and wherein said step of applying said layer (3) comprises galvanically depositing a copper layer.

13. The method of claim 1, wherein said step of forming said receptor depressions or cells (9) in said layer (3) of ink accepting material comprises at least one of: engraving; embossing; etching.

14. The method of claim 1, wherein sad roller or cylinder core (2) comprises steel and said ribs of wear-resistant material comprise chromium dioxide or aluminum oxide.

15. The method of claim 1, wherein said step of filling said grooves (4) with said wear-resistant material comprises applying a surface layer of said material, by plasma-spraying; and further including the steps of surface grinding and polishing the surface of the thus sprayed roller or cylinder core (2) with said grooved layer (3) of ink accepting material therebetween, thereby removing the surface coating of said wear-resistant material from the regions of said layer (3) of ink accepting material, thereby leaving a smooth uniform surface (7) having said ribs (8) of said wear-resistant material formed therein and said ink accepting material, with the surface thereof exposed, positioned between said ribs.

16. The method of claim 15, wherein said step of forming said receptor depressions or cells (9) in said layer (3) is carried out subsequent to the formation of said smooth surface, and includes at least one of: engraving; forming the depressions of embossing; etching.

* * * * *